US012252764B2

(12) United States Patent
Wang et al.

(10) Patent No.: US 12,252,764 B2
(45) Date of Patent: Mar. 18, 2025

(54) COMPOSITE-STRENGTHENED HEAT-RESISTANT AND WEAR-RESISTANT ALUMINUM ALLOY AND PREPARATION METHOD THEREOF

(71) Applicant: Jiangsu University, Jiangsu (CN)

(72) Inventors: Hongming Wang, Jiangsu (CN); Wenxue Su, Jiangsu (CN); Guirong Li, Jiangsu (CN); Yujie Liu, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 18/279,588

(22) PCT Filed: Mar. 9, 2023

(86) PCT No.: PCT/CN2023/080540

§ 371 (c)(1),
(2) Date: Aug. 30, 2023

(87) PCT Pub. No.: WO2024/001288

PCT Pub. Date: Jan. 4, 2024

(65) Prior Publication Data

US 2025/0019801 A1 Jan. 16, 2025

(30) Foreign Application Priority Data

Jun. 30, 2022 (CN) ..... 202210756363.2

(51) Int. Cl.
*C22C 21/02* (2006.01)
*C22C 1/02* (2006.01)
(Continued)

(52) U.S. Cl.
CPC ..... *C22C 21/02* (2013.01); *C22C 1/026* (2013.01); *C22C 1/06* (2013.01); *C22F 1/043* (2013.01)

(58) Field of Classification Search
None
See application file for complete search history.

(56) References Cited

U.S. PATENT DOCUMENTS

2021/0301375 A1 9/2021 Park et al.

FOREIGN PATENT DOCUMENTS

CN 108723371 11/2018
CN 109136599 1/2019
(Continued)

OTHER PUBLICATIONS

"International Search Report (Form PCT/ISA/210) of PCT/CN2023/080540", mailed on May 31, 2023, pp. 1-5.
(Continued)

*Primary Examiner* — George Wyszomierski
*Assistant Examiner* — Janell C Morillo
(74) *Attorney, Agent, or Firm* — JCIPRNET

(57) ABSTRACT

The present disclosure relates to a composite-strengthened heat-resistant and wear-resistant aluminum alloy and a preparation method thereof, and belongs to the field of preparation of high-performance metal materials. In the composite-strengthened heat-resistant and wear-resistant aluminum alloy of the present disclosure, an Al—Si—Cu—Mg alloy is adopted as a matrix, and microalloying elements for improving the heat resistance and a heat-resistant high-entropy alloy (HEA) for improving the wear resistance are added to allow composite strengthening. The preparation method mainly includes the following steps sequentially: smelting and alloying, blowing and refining, blow-compounding, die-casting molding, solution treatment, water quenching, and cryogenic and aging composite heat treatment.

7 Claims, 1 Drawing Sheet

(51) Int. Cl.
*C22C 1/06* (2006.01)
*C22F 1/043* (2006.01)

(56) References Cited

FOREIGN PATENT DOCUMENTS

| | | |
|---|---|---|
| CN | 110523997 | 12/2019 |
| CN | 113088746 | 7/2021 |
| CN | 114622119 | 6/2022 |
| WO | 2017164709 | 9/2017 |

OTHER PUBLICATIONS

"Written Opinion of the International Searching Authority (Form PCT/ISA/237) of PCT/CN2023/080540", mailed on May 31, 2023, pp. 1-3.

COMPOSITE-STRENGTHENED HEAT-RESISTANT AND WEAR-RESISTANT ALUMINUM ALLOY AND PREPARATION METHOD THEREOF

CROSS-REFERENCE TO RELATED APPLICATION

This application is a 371 of international application of PCT application serial no. PCT/CN2023/080540, filed on Mar. 9, 2023, which claims the priority benefit of China application no. 202210756363.2, filed on Jun. 30, 2022. The entirety of each of the above mentioned patent applications is hereby incorporated by reference herein and made a part of this specification.

TECHNICAL FIELD

The present disclosure belongs to the technical field of aluminum alloy preparation, and specifically relates to a heat-resistant and wear-resistant aluminum alloy that undergoes composite strengthening by microalloying and a high-entropy alloy (HEA), and a preparation method thereof.

BACKGROUND ART

With the rapid development of fields such as aerospace, high-speed rail transit, and automobiles, the application of aluminum alloys is increasingly extensive, the requirements for performance of aluminum alloy materials are continuously improved, and advanced requirements have been put forward for performance of aluminum alloys used in new energy and lightweight vehicles. For example, heat-resistant aluminum alloys need to have sufficient oxidation resistance and creep resistance, high-temperature wear resistance, strong hardness at a high temperature, or the like. Such heat-resistant aluminum alloys have been widely demanded in industries such as weapons, ships, aerospace, and automobiles, but traditional aluminum alloy materials are difficult to meet harsh requirements such as high temperature resistance, high specific strength, and high wear resistance in these fields. For example, components such as a piston and a cylinder liner on an engine all need to serve for a long time at 350° C. to 400° C. and bear sufficient load, thermal fatigue, friction, or the like; and problems caused by insufficient heat resistance and wear resistance of existing materials are increasingly prominent.

Microalloying is an important way to tap a potential of an alloy, improve the performance of an alloy, and further develop a novel aluminum alloy. There are many types of microalloying elements, and functions and mechanisms of these microalloying elements are not exactly the same. Controlling a type and amount of a trace element and giving full play to a role of a trace element is a goal of unremitting efforts for developing aluminum alloys, and is also one of the main directions of current research on aluminum alloys. Existing studies have shown that, among all microalloying elements, Sc has a significant microalloying effect, but is very expensive, and thus a Sc-containing aluminum alloy has a very high price and can hardly be widely used in the industrial field. Therefore, it is necessary to find a microalloying element that is equivalent to or more effective than Sc and a novel alloy system.

Due to a hysteretic diffusion effect of an HEA, such alloys have excellent corrosion resistance, high temperature resistance, and wear resistance that are close to these properties of ceramic non-metallic materials, but have higher strength and toughness than ceramic materials. That is, an HEA still retains most of characteristics of a metal alloy, and also a lattice structure of a metal to provide a prominent matching relationship with other metals having similar lattice constants. If an appropriate HEA system is selected as a strengthening phase for an aluminum alloy matrix, it will be very promising to further improve the high temperature strength and frictional wear resistance of an aluminum alloy.

In summary, for the current heat-resistant and wear-resistant aluminum alloys, on the basis of Al—Si, Al—Cu, and Al—Mg—Si wear-resistant aluminum alloys, an Al—Si—Cu—Mg alloy is selected as a matrix, wear-resistant strengthening alloy elements Hf, Zr, Ti, and V are selectively added to improve the high temperature performance, and an HEA matching with the matrix Al—Si—Cu—Mg alloy and the elements Hf, Zr, Ti, and V is used as a composite strengthening phase to develop a novel heat-resistant and wear-resistant aluminum alloy; and a special preparation method is used to promote the precipitation of a wear-resistant and high-temperature phase to play a strengthening role, which significantly improves the high-temperature wear resistance of current heat-resistant and wear-resistant aluminum alloys, will enhance the application of aluminum alloys in extensive high-end fields, and has very promising application prospects.

SUMMARY OF INVENTION

An objective of the present disclosure is to provide a composite-strengthened heat-resistant and wear-resistant aluminum alloy and a preparation method thereof. Specifically, an optimized heat-resistant and wear-resistant aluminum alloy matrix is selected, and the performance of the heat-resistant and wear-resistant aluminum alloy is improved through composite strengthening by microalloying and an HEA; and an optimal preparation method of the composite-strengthened heat-resistant and wear-resistant aluminum alloy is provided, to solve the problem that the performance of the current heat-resistant and wear-resistant aluminum alloy needs to be improved.

The objective of the present disclosure is achieved by the following technical solutions.

A composite-strengthened heat-resistant and wear-resistant aluminum alloy is provided, where an Al—Si—Cu—Mg alloy is adopted as a matrix, and microalloying elements Ti, Zr, Hf, and V, and an HEA $Al_{1.5}Ti_{0.5}Zr_{0.5}V_{0.5}Hf_{0.5}$ are blown into a melt of the matrix for composite strengthening.

Further, the Al—Si—Cu—Mg alloy matrix includes the following elements in mass percentages: Si: 9.5% to 12.0%, Cu: 2.0% to 4.0%, Mg: 0.6% to 0.8%, and Al: the balance.

Further, the microalloying elements Ti, Zr, Hf, and V are added in mass percentages as follows: Ti: 0.05% to 0.25%, Zr: 0.05% to 0.25%, Hf: 0.01% to 0.05%, and V: 0.08% to 0.25%.

Further, in the HEA $Al_{1.5}Ti_{0.5}Zr_{0.5}V_{0.5}Hf_{0.5}$ for composite strengthening, Al, Ti, Zr, V, and Hf are in an atomic ratio of 1.5:0.5:0.5:0.5:0.5; and an amount of the HEA is 1 wt. % to 3 wt. % of an amount of the Al—Si—Cu—Mg alloy matrix.

Further, the composite-strengthened heat-resistant and wear-resistant aluminum alloy includes a Si phase and $Al_3Zr$, $Al_3Ti$, $Al_3Hf$, $Al_2Cu$, $Mg_2Cu$, $Mg_2Si$, and $Al_{1.5}Ti_{0.5}Zr_{0.5}V_{0.5}Hf_{0.5}$ composite phases as heat-resistant and wear-resistant phases.

A preparation method of the composite-strengthened heat-resistant and wear-resistant aluminum alloy is provided, including the following steps:

step 1: smelting and alloying: melting an industrial pure aluminum ingot in a heating furnace, and adding an aluminum-silicon alloy, an aluminum-magnesium alloy, and an aluminum-copper alloy successively, where mass percentages of components are controlled as follows: Si 9.5% to 12.0%, Cu: 2.0% to 4.0%, and Mg: 0.6% to 0.8%; and performing microalloying with alloying elements Ti, Zr, Hf, and V, where mass percentages of the alloying elements Ti, Zr, Hf, and V are controlled as follows: Ti: 0.05% to 0.25%, Zr: 0.05% to 0.25%, Hf: 0.01% to 0.05%, and V: 0.08% to 0.25%;

step 2: blowing and refining: blowing argon to allow refining at 700° C. to 740° C.;

step 3: blow-compounding: with argon as a carrier gas, blowing an HEA $Al_{1.5}Ti_{0.5}Zr_{0.5}V_{0.5}Hf_{0.5}$ powder into an a melt obtained from the step 2, blowing for thorough stirring while controlling the aluminum alloy melt at 700° C., and allowing the aluminum alloy melt to stand for 10 min to 15 min; and step 4: cast molding: injecting the melt into a casting machine to allow cast molding.

Further, in the step 4, the cast molding is die-casting molding, the melt when at 680° C. to 700° C. is injected into a die-casting machine for die-casting molding, and the die-casting molding is performed under a pressure of 80 MPa to 90 MPa.

Further, the preparation method further includes: step 5: a solution-aging treatment: heating a resulting cast alloy to a temperature of 530° C. to 540° C., keeping the cast alloy at the temperature for 6 h to 12 h, and furnace-cooling.

Further, the preparation method further includes: step 5: a solution-water quenching heat treatment: cooling a cast alloy obtained in the step 4 to room temperature, allowing the cast alloy to stand, heating the cast alloy to 535° C. to 545° C., and performing a solution treatment for 60 min to 80 min; and after the solution treatment is completed, performing water quenching with water at 25° C. to 40° C. for 30 s to 60 s, and after the water quenching is completed, cooling the cast alloy to room temperature.

Further, the step 5 further includes a cryogenic treatment, where the cryogenic treatment is performed with liquid nitrogen at −196° C. for 24 h to 36 h after the water quenching and a surface-drying.

The present disclosure has the following advantages.

1) In the composite-strengthened heat-resistant and wear-resistant aluminum alloy in the present disclosure, an Al—Si—Cu—Mg alloy is adopted as a matrix. In the existing Al—Si, Al—Cu, and Al—Si—Mg wear-resistant and heat-resistant alloys, heat-resistant and wear-resistant phases are a single Si phase, an $Al_2Cu$ phase, and an $Mg_2Si$ phase; and in the Al—Si—Cu—Mg alloy of the present disclosure, heat-resistant and wear-resistant phases are a Si phase, an $Al_2Cu$ phase, an $Mg_2Cu$ phase, and an $Mg_2Si$ phase. In contrast, in the present disclosure, the number and types of strengthening phases are increased, which can significantly improve the wear resistance and high temperature resistance.

2) The microalloying elements Ti, Zr, Hf, and V added in the composite-strengthened heat-resistant and wear-resistant aluminum alloy of the present disclosure can not only play a role of grain refinement and improve a hardness at a high temperature (namely, high temperature resistance), but also precipitate in forms of $Al_3Hf$, $Al_3Zr$, and $Al_3Ti$ in the Al—Si—Cu—Mg alloy matrix to produce wear-resistant phases, thereby improving the wear resistance and the hardness of the material at a high temperature.

3) In the composite-strengthened heat-resistant and wear-resistant aluminum alloy of the present disclosure, an HEA $Al_{1.5}Ti_{0.5}Zr_{0.5}V_{0.5}Hf_{0.5}$ is added for further strengthening, and the HEA is an AlTiZrVHf HEA obtained by introducing an Al element into a high-temperature-resistant TiZrVHf HEA. The AlTiZrVHf HEA has an excellent common lattice relationship with the matrix in the aluminum alloy, and Al, Ti, Zr, V, and Hf in the AlTiZrVHf HEA are in an atomic ratio of 1.5:0.5:0.5:0.5:0.5, which facilitates the stable coexistence of the HEA with $Al_3Hf$, $Al_3Zr$, and $Al_3Ti$ in the Al—Si—Cu—Mg alloy matrix, thereby playing a role of composite strengthening.

4) Compared with the current wear-resistant and heat-resistant aluminum alloys on the market such as Al—Si die-casting aluminum alloy A360 (Comparative Example 1), Al—Si—Cu die-casting aluminum alloy A380 (Comparative Example 2), Al—Cu—Mg aluminum alloy 2024(Comparative Example 3), and Al—Zn—Mg—Cu superhard aluminum alloy 7075 (Comparative Example 4), under the same test conditions, an alloy with the same composition as that in the present disclosure obtained without the solution treatment-water quenching-cryogenic composite heat treatment of the present disclosure (Example 1 and Example 2) has a wear weight loss reduced by 20% or more, that is, the wear resistance can be increased by 20% or more; and the alloy has a heat resistance temperature (namely, a temperature causing a strength failure) increased by 55° C. to 105° C., indicating that the composite-strengthened heat-resistant and wear-resistant aluminum alloy of the present disclosure undergoes a significant progress.

5) An outstanding feature of the preparation method of the composite-strengthened heat-resistant and wear-resistant aluminum alloy of the present disclosure is sequential die-casting molding and solution-water quenching-cryogenic composite heat treatment after compounding of an HEA with an aluminum alloy melt. For the characteristics of the composite melt of the present disclosure, the die-casting molding is conducive to improvement of uniformity and density of material structures during molding, where the wear resistance can be improved by about 10% and the high temperature resistance can also be significantly improved (Example 1 and Example 2). In addition, the solution-water quenching-cryogenic composite heat treatment in the preparation method of the present disclosure can significantly promote the precipitation of Si, $Al_3Hf$, $Al_3Zr$, $Al_3Ti$, $Al_2Cu$, $Mg_2Cu$, $Mg_2Si$, and $Al_{1.5}Ti_{0.5}Zr_{0.5}V_{0.5}Hf_{0.5}$ phases in the aluminum alloy to further improve the heat resistance and wear resistance of the material by 10% or more, indicating that the preparation method of the composite-strengthened heat-resistant and wear-resistant aluminum alloy of the present disclosure undergoes a significant progress. In summary, the preparation method of the composite-strengthened heat-resistant and wear-resistant aluminum alloy of the present disclosure can further improve the heat resistance and wear resistance of the alloy material by about 20%.

DESCRIPTION OF EMBODIMENTS

Figure 1:
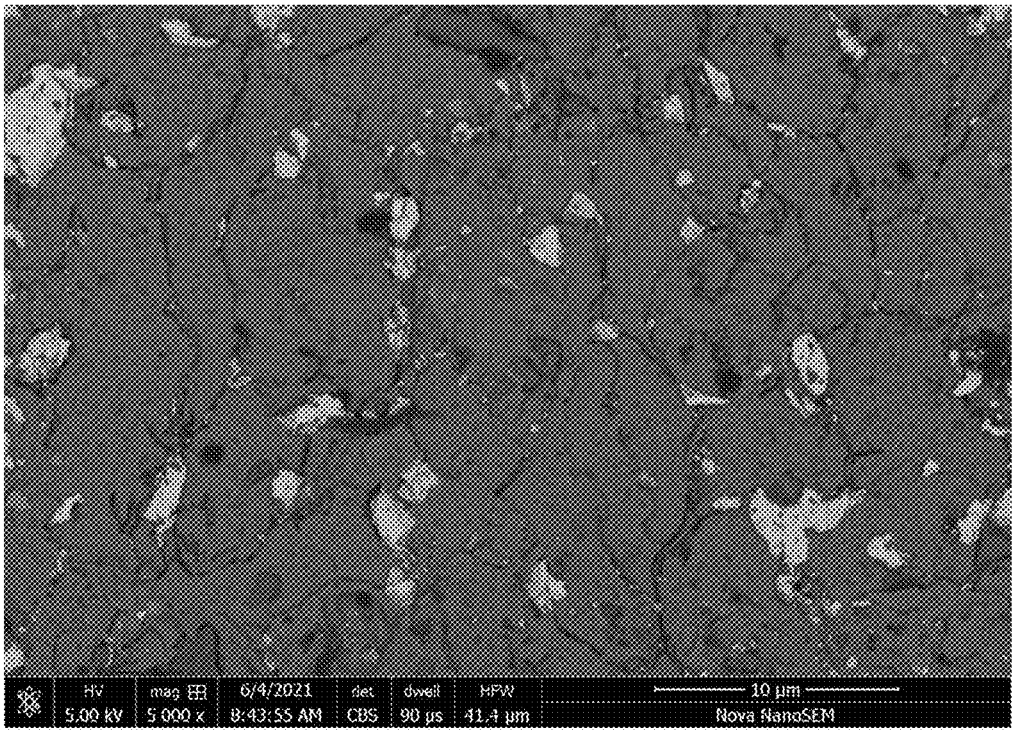
FIG. 1 is a scanning electron microscopy (SEM) image of a metallographic structure of the composite-strengthened heat-resistant and wear-resistant aluminum alloy obtained in Example 2 of the present disclosure.

In order to allow those skilled in the art to well understand the technical solutions of the present disclosure, the present disclosure is further described in detail below in conjunction with the accompanying drawings. It should be understood that these examples are provided merely to illustrate the present disclosure, but not to limit the scope of the present disclosure in any way. In the following examples, various processes and methods that are not described in detail are conventional methods well known in the art.

A microhardness test of an aluminum alloy is performed on a digital microhardness tester; a wear test of an aluminum alloy is performed on an MMU-5GA microcomputer-controlled high-temperature friction wear testing machine; a specimen is a pin-shaped specimen with a size of 4.8 mm×12.7 mm, and a grinding material is GCr15 steel processed into a D54 mm×8 mm disc specimen; dry sliding friction wear is adopted, an experimental temperature is 25° C., a load is 150N, a rotational speed is 50 r/min, and a wear time is 20 min; the wear resistance is expressed by a wear weight loss; and the high temperature resistance is measured by tensile strength and hardness indexes at 300° C.

Example 1

In this example, an Al—Si—Cu—Mg alloy matrix included the following target elements in mass percentages: Si: 10.5%, Cu: 3.0%, Mg: 0.7%, and Al: the balance; microalloying elements Ti, Zr, Hf, and V were added according to the following amounts: Ti: 0.15%, Zr: 0.15%, Hf: 0.02%, and V: 0.15%; and a mass percentage of an $Al_{1.5}Ti_{0.5}Zr_{0.5}V_{0.5}Hf_{0.5}$ HEA was 2% of a mass percentage of the Al—Si—Cu—Mg alloy matrix. Unless otherwise specified, the contents of all components in the present disclosure were expressed in mass percentages.

In this example, atmospheric pressure casting was adopted, and a preparation process was as follows.

Step 1: Smelting and Alloying 100 kg of an industrial pure aluminum ingot was melted in a medium-frequency induction heating furnace and heated to 700° C., and an aluminum-silicon alloy, an aluminum-magnesium alloy, and an aluminum-copper alloy were added successively to prepare an Al—Si—Cu—Mg alloy matrix, where contents of Si, Mg, and Cu were controlled as follows: Si: 10.5%, Cu: 3.0%, and Mg: 0.7%; and microalloying was performed with Ti, Zr, Hf, and V, where contents of the alloying elements Ti, Zr, Hf, and V were controlled as follows: Ti: 0.15%, Zr: 0.15%, Hf: 0.02%, and V: 0.15%.

Step 2: Blowing and Refining

A specific process of step 2 was as follows: Argon was blown to allow refining at 720° C. for 15 min.

Step 3: Blow-Compounding

After the blowing and refining was completed, with argon as a carrier gas, an HEA $Al_{1.5}Ti_{0.5}Zr_{0.5}V_{0.5}Hf_{0.5}$ powder for composite strengthening was blown into an aluminum alloy melt, blowing was performed for thorough stirring while controlling the aluminum alloy melt at 700° C., and the resulting melt was allowed to stand for 10 min.

Step 4: Atmospheric Pressure Casting Was Performed.

Example 2

The same composition and the same steps 1, 2, and 3 as those in Example 1 were adopted in this example, but die-casting molding was adopted in step 4. Specifically, a melt was injected into a die-casting machine when at 690° C., and the die-casting molding was performed with a casting pressure of 85 MPa and a holding time of 15 s.

The preparation method further included: Step 5, Solution-aging heat treatment

The resulting cast alloy was heated to 530° C. to 540° C., kept at this temperature for 6 h to 12 h, and then furnace-cooled.

An SEM image of a metallographic structure of the composite-strengthened heat-resistant and wear-resistant aluminum alloy obtained in Example 2 was shown in FIG. 1.

Example 3

The same composition and the same steps 1, 2, and 3 as those in Example 1 were adopted in this example, but die-casting molding was adopted in step 4. Specifically, a melt was injected into a die-casting machine when at 690° C., and the die-casting molding was performed with a casting pressure of 85 MPa and a holding time of 15 s.

The preparation method further included: Step 5, Solution treatment-water quenching-cryogenic composite heat treatment.

A cast alloy obtained in step 4 was cooled to room temperature, then allowed to stand for more than 12 h, and subjected to a solution treatment in a heating furnace at 540° C. for 70 min; after the solution treatment was completed, the cast alloy was quenched with water at 30° C. for 35 s; and after the quenching was completed, the cast alloy was cooled to room temperature, the surface water was wiped off, and the cast alloy was subjected to a cryogenic treatment directly in liquid nitrogen at −196° C. for 30 h, then taken out, and naturally warmed to room temperature.

Figure 2:
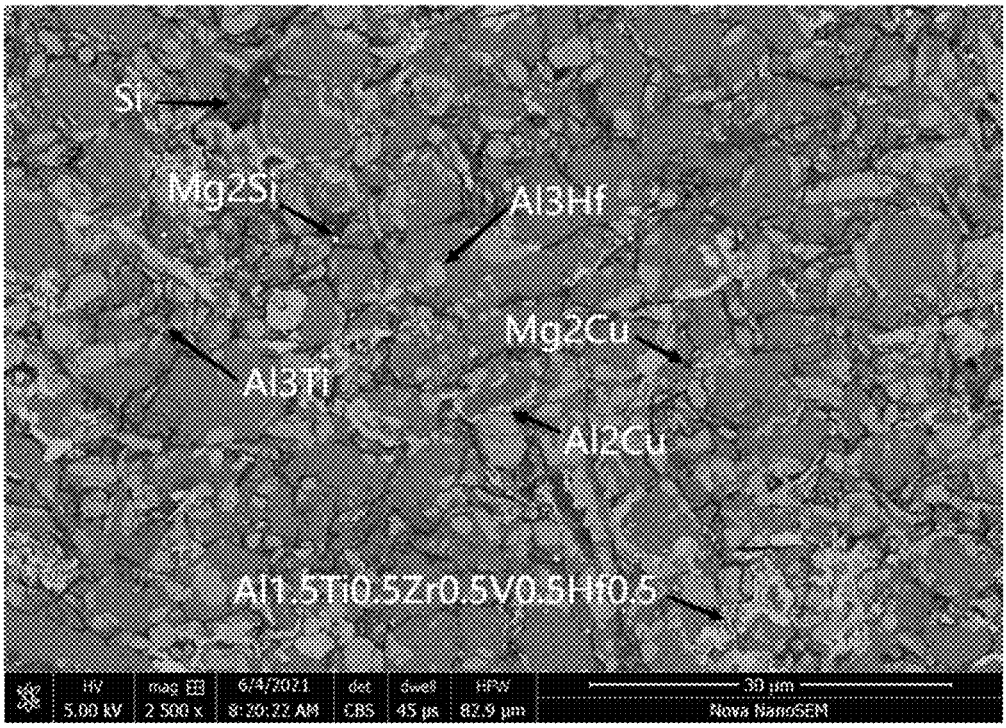
FIG. 2 is an SEM image of a metallographic structure of the composite-strengthened heat-resistant and wear-resistant aluminum alloy obtained in Example 3 of the present disclosure.

An SEM image of a metallographic structure of the composite-strengthened heat-resistant and wear-resistant aluminum alloy obtained in Example 3 was shown in FIG. 2. Heat-resistant and wear-resistant phases in the prepared aluminum alloy included a Si phase and $Al_3Hf$, $Al_3Zr$, $Al_3Ti$, $Al_2Cu$, $Mg_2Cu$, $Mg_2Si$, and $Al_{1.5}Ti_{0.5}Zr_{0.5}V_{0.5}Hf_{0.5}$ composite phases. Compared with the material prepared in Example 2, a number of composite phases in the material prepared in this example was significantly increased.

The aluminum alloy prepared in Example 1 was subjected to a friction wear test, a microhardness test, and tensile strength and hardness tests reflecting heat resistance at 350° C. and experimental results were shown in Table 1. In contrast to the present disclosure, the current wear-resistant and heat-resistant aluminum alloys of Al—Si die-casting aluminum alloy A360, Al—Si—Cu die-casting aluminum alloy A380, Al—Cu—Mg aluminum alloy 2024, and Al—Zn—Mg—Cu superhard aluminum alloy 7075 on the market were adopted as Comparative Examples 1, 2, 3, and 4,respectively, these aluminum alloys were compared with the aluminum alloys prepared in Examples 1, 2, and 3, and results were shown in Table 1.

TABLE 1

Comparison of performance data of the examples and comparative examples

| | Wear weight loss, mg | Hardness at room temperature, Hv | Tensile strength at a high temperature, MPa | Hardness at a high temperature, Hv | Strength-failing temperature/° C. |
|---|---|---|---|---|---|
| Example 1 (atmospheric pressure casting) | 120 | 155 | 320 | 140 | 380 |
| Example 2 (die casting + solution-aging treatment) | 105 | 170 | 330 | 150 | 390 |
| Example 3 (die casting + solution treatment-water quenching-cryogenic composite heat treatment) | 95 | 180 | 370 | 175 | 395 |
| Comparative Example 1 (A360) | 220 | 85 | 97 | 70 | 290 |
| Comparative Example 2 (A380) | 200 | 95 | 100 | 75 | 290 |
| Comparative Example 3 (2024) | 140 | 140 | 290 | 120 | 300 |
| Comparative Example 4 (7075) | 135 | 150 | 310 | 125 | 340 |

It can be seen from the comparison of performance test results of examples and Comparative Examples 1 to 4 in Table 1 that, compared with the current major wear-resistant and heat-resistant aluminum alloys on the market, the heat-resistant and wear-resistant aluminum alloy obtained in the present disclosure is significantly improved in terms of a wear weight loss index and a room-temperature hardness index reflecting wear resistance, where the wear resistance at room temperature is increased by 20% or more, the hardness at room temperature is increased by 17% or more, the tensile strength at a high temperature is increased by 19.4% or more, the hardness at a high temperature is increased by 40%, and the strength-failing temperature is increased by 55° C. to 105° C.

It can be seen from test results of the composite-strengthened heat-resistant and wear-resistant aluminum alloy materials prepared in Examples 1 and 2 of the present disclosure and the current heat-resistant wear-resistant alloys adopted in Comparative Examples 1 to 4 that the composite-strengthened heat-resistant and wear-resistant aluminum alloy of the present disclosure has obvious performance advantages in terms of wear resistance, room temperature hardness, high temperature tensile strength, high temperature hardness, and heat resistance temperature, indicating that the composite-strengthened heat-resistant and wear-resistant aluminum alloy of the present disclosure has significant outstanding progress characteristics compared with the existing materials.

It can be seen from the comparison of Example 3 with Examples 1 and 2 that the die-casting molding and solution treatment-water quenching-cryogenic composite heat treatment in the preparation method of the composite-strengthened heat-resistant and wear-resistant aluminum alloy of the present disclosure have beneficial effects and progresses.

In a word, it can be seen from the comparison between examples and comparative examples that the composite-strengthened heat-resistant and wear-resistant aluminum alloy and the preparation method thereof in the present disclosure have significant progresses and obvious beneficial effects compared with the prior art.

What is claimed is:

1. A composite-strengthened heat-resistant and wear-resistant aluminum alloy, comprising an Al—Si—Cu—Mg alloy matrix, microalloying elements Ti, Zr, Hf, and V added to the alloy matrix, and further comprising a high-entropy alloy powder $Al_{1.5}Ti_{0.5}Zr_{0.5}V_{0.5}Hf_{0.5}$ blown into a melt of the aluminum alloy for composite strengthening; wherein the Al—Si—Cu—Mg alloy matrix comprises the following elements in mass percentages: Si: 9.5% to 12.0%, Cu: 2.0% to 4.0%, Mg: 0.6% to 0.8%, and Al: the balance; the microalloying elements Ti, Zr, Hf, and V are added in mass percentages as follows: Ti: 0.05% to 0.25%, Zr: 0.05% to 0.25%, Hf: 0.01% to 0.05%, and V: 0.08% to 0.25%: and an amount of the high-entropy alloy powder added is 1 wt. % to 3 wt. % of an amount of the aluminum alloy matrix.

2. The composite-strengthened heat-resistant and wear-resistant aluminum alloy according to claim 1, wherein heat-resistant and wear-resistant phases existing in the alloy comprise composite phases of Si, $Al_3Zr$, $Al_3Ti$, $Al_3Hf$, $Al_2Cu$, $Mg_2Cu$, $Mg_2Si$, and $Al_{1.5}Ti_{0.5}Zr_{0.5}V_{0.5}Hf_{0.5}$.

3. A preparation method of the composite-strengthened heat-resistant and wear-resistant aluminum alloy according to claim 1, comprising the following steps:

step 1: smelting and alloying: melting an industrial pure aluminum ingot in a heating furnace, and adding an aluminum-silicon alloy, an aluminum-magnesium alloy, and an aluminum-copper alloy successively, wherein mass percentages of components are controlled as follows: Si 9.5% to 12.0%, Cu: 2.0% to 4.0%, and Mg: 0.6% to 0.8%; and performing microalloying with alloying elements Ti, Zr, Hf, and V, wherein mass percentages of the alloying elements Ti, Zr, Hf, and V are controlled as follows: Ti: 0.05% to 0.25%, Zr: 0.05% to 0.25%, Hf: 0.01% to 0.05%, and V: 0.08% to 0.25%;

step 2: blowing and refining: blowing argon to allow refining at 700° C. to 740° C.;

step 3: blow-compounding: with argon as a carrier gas, blowing a high-entropy alloy powder $Al_{1.5}Ti_{0.5}Zr_{0.5}V_{0.5}Hf_{0.5}$ into a melt of the aluminum alloy, blowing for thorough stirring while controlling the melt at 700° C., and allowing the melt to stand for 10 min to 15 min to wait for molding; and step 4: cast molding: injecting the melt into a casting machine to allow cast molding.

4. The preparation method of the composite-strengthened heat-resistant and wear-resistant aluminum alloy according to claim 3, wherein in the step 4, the cast molding is die-casting molding, the melt is injected into a die-casting machine for die-casting molding at 680° C. to 700° C., and the die-casting molding is performed under a pressure of 80 MPa to 90 MPa.

5. The preparation method of the composite-strengthened heat-resistant and wear-resistant aluminum alloy according to claim 4, further comprising: step 5: a solution-aging treatment: heating an obtained cast alloy to a temperature of 530° C. to 540° C., keeping the cast alloy at the temperature for 6 h to 12 h, and furnace-cooling.

6. The preparation method of the composite-strengthened heat-resistant and wear-resistant aluminum alloy according to claim 4, further comprising: step 5: a solution-water quenching heat treatment: cooling a cast alloy obtained in the step 4 to room temperature, allowing the cast alloy to stand, heating the cast alloy to 535° C. to 545° C., and performing a solution treatment for 60 min to 80 min; and after the solution treatment is completed, performing water quenching with water temperature at 25° C. to 40° C. for 30 s to 60 s, and after the water quenching is completed, cooling the cast alloy to room temperature.

7. The preparation method of the composite-strengthened heat-resistant and wear-resistant aluminum alloy according to claim 6, wherein the step 5 further comprises a cryogenic treatment, and the cryogenic treatment is performed with liquid nitrogen at −196° C. for 24 h to 36 h after the water quenching and a surface-drying.

* * * * *